US010996580B2

(12) United States Patent
Shimura et al.

(10) Patent No.: US 10,996,580 B2
(45) Date of Patent: May 4, 2021

(54) IMAGE FORMING APPARATUS

(71) Applicant: CANON KABUSHIKI KAISHA, Tokyo (JP)

(72) Inventors: Hiromi Shimura, Toride (JP); Hiroto Nishihara, Tsukuba (JP); Keita Takahashi, Abiko (JP); Teruhito Kai, Kamagaya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/985,064

(22) Filed: Aug. 4, 2020

(65) Prior Publication Data

US 2021/0063907 A1 Mar. 4, 2021

(30) Foreign Application Priority Data

Aug. 30, 2019 (JP) ..... JP2019-158964

(51) Int. Cl.
*G03G 15/16* (2006.01)
*G03G 15/01* (2006.01)

(52) U.S. Cl.
CPC ..... *G03G 15/0136* (2013.01); *G03G 15/1615* (2013.01)

(58) Field of Classification Search
CPC ..... G03G 15/0136; G03G 15/1605; G03G 15/1615; G03G 2215/0193
USPC ..... 399/38, 66, 308
See application file for complete search history.

(56) References Cited

U.S. PATENT DOCUMENTS 8,346,138 B2 * 1/2013 Sugitani ..... G03G 15/0136 399/299
8,467,709 B2 * 6/2013 Kogure ..... G03G 15/1615 399/301
8,571,450 B2 * 10/2013 Ichihashi ..... G03G 15/0136 399/299
9,037,014 B2 * 5/2015 Yoshioka ..... G03G 15/6594 399/45

FOREIGN PATENT DOCUMENTS

JP 4164503 B2 10/2008

* cited by examiner

*Primary Examiner* — Hoan H Tran
(74) *Attorney, Agent, or Firm* — Canon U.S.A., Inc. I.P. Division

(57) ABSTRACT

An image forming apparatus includes a first image forming unit and a second image forming unit to form first toner images and second toner images, respectively, of different colors, a transfer member to transferred received toner images to a position, and a contact/separation unit to switch between first and second modes. Where a first, second, and third image are formed in order on sheets, the mode is switched from the first to the second mode after the transfer member receives the first image to the transfer member and before formation of the second image by the first image forming unit is started if a first image length in a conveyance direction is smaller than a predetermined length. After the sheet receives the first image, the contact/separation unit switches the mode from the first to the second mode if the first image length is greater than the predetermined length.

7 Claims, 9 Drawing Sheets

IMAGE FORMING APPARATUS

BACKGROUND

Field

The present disclosure relates to an image forming apparatus in which an intermediate transfer member and a photosensitive member are separated from each other.

Description of the Related Art

In a recent color copier, photosensitive drums of a plurality of colors come into contact with a rotatable intermediate transfer member, images of respective colors are sequentially superimposed on the intermediate transfer member to form a full color image, and the full color image is transferred to a printing sheet. Further, the color copier normally includes a full color mode in which a full color image is formed using the photosensitive drums of the plurality of colors, and a monochrome mode in which a monochrome image is formed using only a black drum. It is unnecessary to maintain the photosensitive drums of colors other than black in an image formable state when the monochrome image is formed. Therefore, the copier switches a mode between the monochrome mode and the full color mode depending on contents of an input job. In particular, in the monochrome mode, the photosensitive drums of colors that are not operated is preferably separated from the intermediate transfer member. For this reason, a contact/separation mechanism that brings the photosensitive drums and the intermediate transfer member into contact with each other and separates the photosensitive drums and the intermediate transfer member from each other is often provided. In addition, in terms of a time from a print start time to a print end time in the monochrome mode, the photosensitive drum of black is commonly disposed on a most downstream side in a rotation direction of the intermediate transfer member.

In the color copier including the above-described configuration, an image to be formed may be not a little influenced by driving of the contact/separation mechanism. In other words, when driving of the contact/separation mechanism is overlapped with an image formation operation or a transfer operation to a printing sheet by any of the photosensitive drums, image defect such as color misalignment and unevenness occurs on the image to be formed. For this reason, to switch the mode from the monochrome mode to the full color mode while avoiding such image defect, an operation in a timing chart illustrated in FIG. 6A is performed. In the timing chart illustrated in FIG. 6A, a case where two pages of monochrome images are followed by two pages of color images is illustrated. In other words, after transfer of a monochrome image on a second page to a printing sheet is completed, the contact operation of the intermediate transfer member is started, and after the contact operation is completed, image formation of a color image on a first page is started. As illustrated in the timing chart, there is a time period Twaste during which the photosensitive drum of black is not being operated between an operation for the monochrome image on the second page and an operation for the color image on the first page. The time period increases a waiting time of a user, and leads to waste consumption of various kinds of parts.

Regarding such matters, in a technique discussed in Japanese Patent No. 4164503, an operation to switch the mode from the monochrome mode to the full color mode is performed during the time period as illustrated in FIG. 6B. As a result, the time necessary for printing is reduced. In other words, a time period when none of the photosensitive drums performs image formation and transfer to the intermediate transfer member and the printing sheet is not performed is generated by delaying start of formation of the monochrome image on the second page, and the contact operation is performed in a state where the monochrome image on the first page is present on a transfer belt. Note that whether the described first page of the monochrome image is located at a head or in the middle of the job is not related to the switching operation.

The above-described existing technique, however, has the following restriction. In the existing technique, it is necessary to generate the time period when none of the photosensitive drums performs image formation and transfer to the intermediate transfer member and the printing sheet is not performed, during a period after the image is transferred from the black photosensitive drum to the intermediate transfer member and until the image is transferred to the printing sheet. To do so, as illustrated in FIGS. 6A and 6B, the image to be printed is required to have a size falling within a section between a position of the black photosensitive drum to a sheet transfer position. In other words, there is a restriction that the above-described control cannot be applied to a monochrome image having a size greater than a distance of the section between the position of the black photosensitive drum to the sheet transfer position as illustrated in FIG. 6C.

SUMMARY

The present disclosure is directed to reduction of a waste time to be generated when a mode is switched from the monochrome mode to the color mode irrespective of the size of the image.

According to an aspect of the present disclosure, an image forming apparatus includes a first image forming unit configured to form a first toner image, a second image forming unit configured to form a second toner image of a color different from a color of the first toner image, an intermediate transfer member to which the first toner image and the second toner image are transferred, and configured to convey the transferred first and second toner images to a sheet transfer position, a contact/separation unit configured to switch a mode between a first mode in which the intermediate transfer member is in contact with the first image forming unit disposed on a downstream side of the second image forming unit in a conveyance direction of the first and second toner images by the intermediate transfer member and the intermediate transfer member is separated from the second image forming unit, and a second mode in which the intermediate transfer member is in contact with the first image forming unit and the second image forming unit, and a controller configured to control an operation of the image forming apparatus, wherein, in a case where a first image, that is a monochrome image formed using the first image forming unit without using the second image forming unit, a second image, that is the monochrome image, and a third image, that is a color image formed using the first image forming unit and the second image forming unit, are formed in order on sheets, the controller controls the contact/separation unit to switch the mode from the first mode to the second mode after transfer of the first image to the intermediate transfer member is completed and before formation of the second image by the first image forming unit is started if a first image length that is a length of the first image in the conveyance direction is smaller than a predetermined length, and wherein, after the first image is transferred to the sheet, the controller controls the contact/separation unit to switch the mode from the first mode to the second mode if the first image length in the conveyance direction is greater than the predetermined length.

Further features of the present disclosure will become apparent from the following description of exemplary embodiments with reference to the attached drawings.

DESCRIPTION OF THE EMBODIMENTS

<Image Forming Apparatus>

Figure 1:
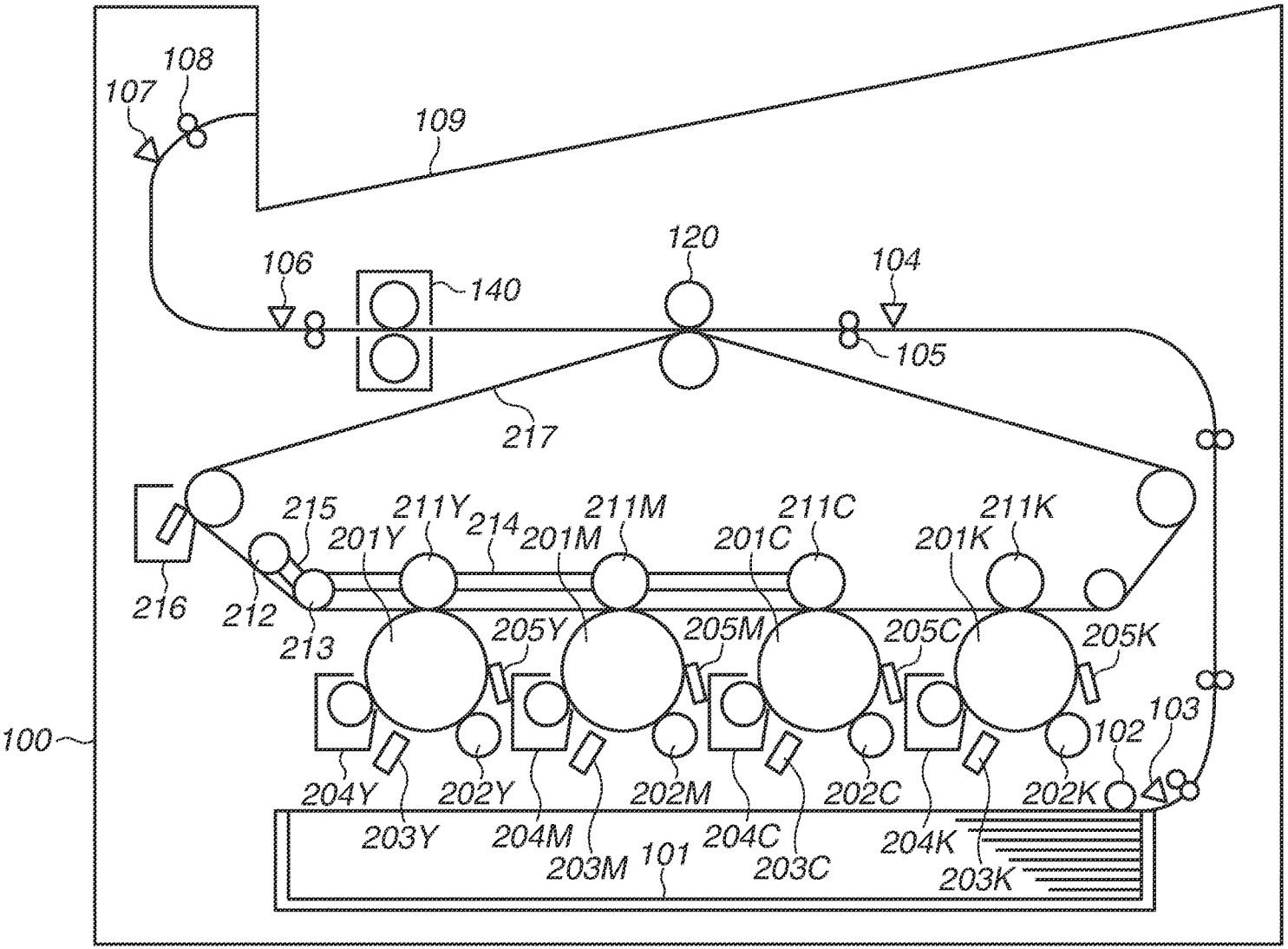
FIG. 1 is a cross-sectional view of an entire image forming apparatus.

FIG. 1 is a cross-sectional view of an image forming apparatus 100 according to a present exemplary embodiment. In FIG. 1, a cassette 101 is provided inside the image forming apparatus 100, and contains a large number of sheets. A pickup roller 102 picks up a sheet contained in the cassette 101, and feeds the sheet to a conveyance path. A sheet sensor 104 is provided on a downstream side of the pickup roller 102 in a sheet conveyance direction. A registration roller 105 is a conveyance roller that adjusts timing when the sheet arrives at a secondary transfer position based on timing when the sheet sensor 104 detects a leading end of the sheet.

An image forming unit includes a photosensitive drum 201Y as a photosensitive member, a charging roller 202Y, a laser unit 203Y, a developer 204Y, and a cleaner 205Y. The photosensitive drum 201 is an image carrier that carries an electrostatic latent image and a toner image. In FIG. 1, characters YMCK following reference numerals represent yellow, magenta, cyan, and block that are toner colors, respectively. In description common to the four colors, the characters representing the toner colors are omitted. The charging roller 202 uniformly charges a surface of the photosensitive drum 201 by using a charging bias.

The laser unit 203 is an exposure device or an optical scanning device that emits a laser beam to the uniformly-charged surface of the photosensitive drum 201, thereby forming the electrostatic latent image. The developer 204 uses a developing bias to cause toner to attach to the electrostatic latent image, and develops the toner image. A contact portion (nip portion) of a primary transfer roller 211 and the photosensitive drum 201 is called a primary transfer portion or a primary transfer position. The primary transfer roller 211 uses a primary transfer bias to transfer the toner image to an intermediate transfer belt 217 as an intermediate transfer member. Ina job for forming a monochrome image on a sheet by using a black image forming unit without using image forming units other than the black image forming unit, a black toner image is transferred from a photosensitive drum 201K to the transfer belt 217. In a job for forming a color image on a sheet by using the four image forming units, toner images of the colors YMCK are sequentially transferred from photosensitive drums 201Y, 201M, 201C, and 201K to the transfer belt 217. A cleaner 205 cleans the toner left on the photosensitive drum 201.

The transfer belt 217 conveys the toner images to a secondary transfer portion (secondary transfer position) while rotating. The secondary transfer portion is a contact portion (nip portion) of the transfer belt 217 and a secondary transfer roller 120. The secondary transfer portion uses a secondary transfer bias to transfer the toner images to a sheet. A fixer 140 applies heat and pressure to the toner images and the sheet, thereby fixing the toner images to the sheet. A discharge roller 108 discharges the sheet to a tray 109.

<Monochrome Mode and Full Color Mode (Separation State and Contact State)>

Figure 2A:
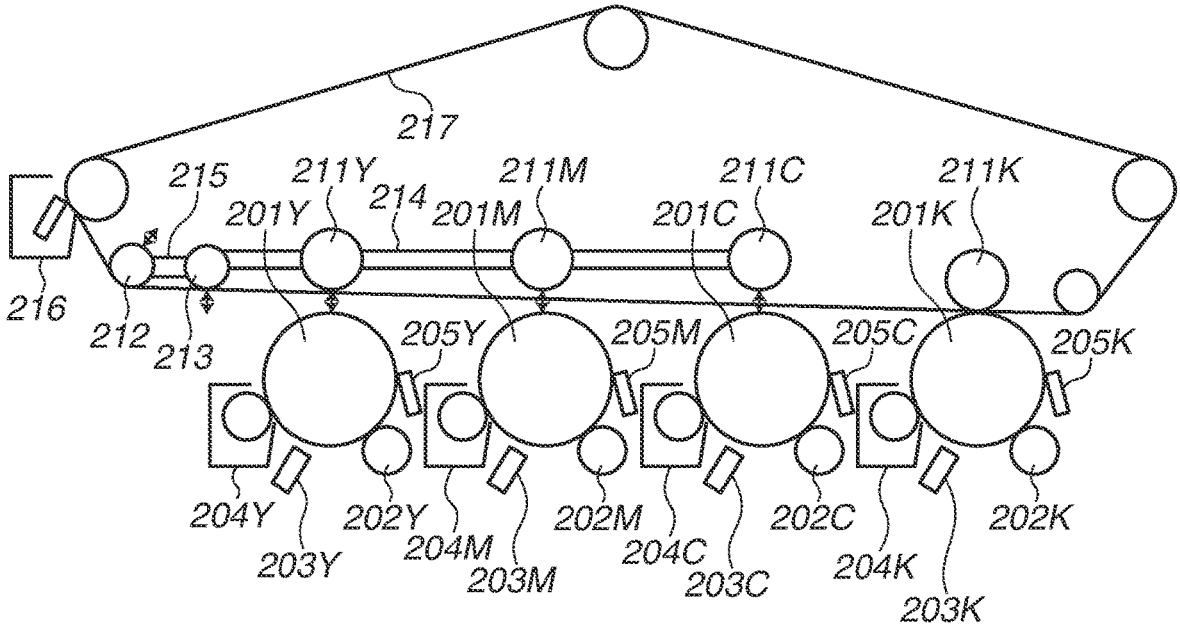
FIGS. 2A and 2B are diagrams illustrating a contact/separation mechanism of a transfer belt.

The image forming apparatus 100 includes a monochrome mode and a full color mode as print color modes. FIG. 2A illustrates a position of the transfer belt 217 in the monochrome mode. In the monochrome mode, to reduce abrasion and consumption of the photosensitive drums 201Y, 201M, and 201C, the photosensitive drums 201Y, 201M, and 201C are separated from the transfer belt 217. A positioning member 214 is a member to position primary transfer rollers 211Y, 211M, and 211C. A positioning member 215 is a member to position tension rollers 212 and 213. As illustrated in FIG. 2A, in the monochrome mode, when the positioning members 214 and 215 are moved to positions that are separated from one another, the primary transfer rollers 211Y, 211M, and 211C are moved upward. As a result, the transfer belt 217 is separated from the photosensitive drums 201Y, 201M, and 201C.

Figure 2B:
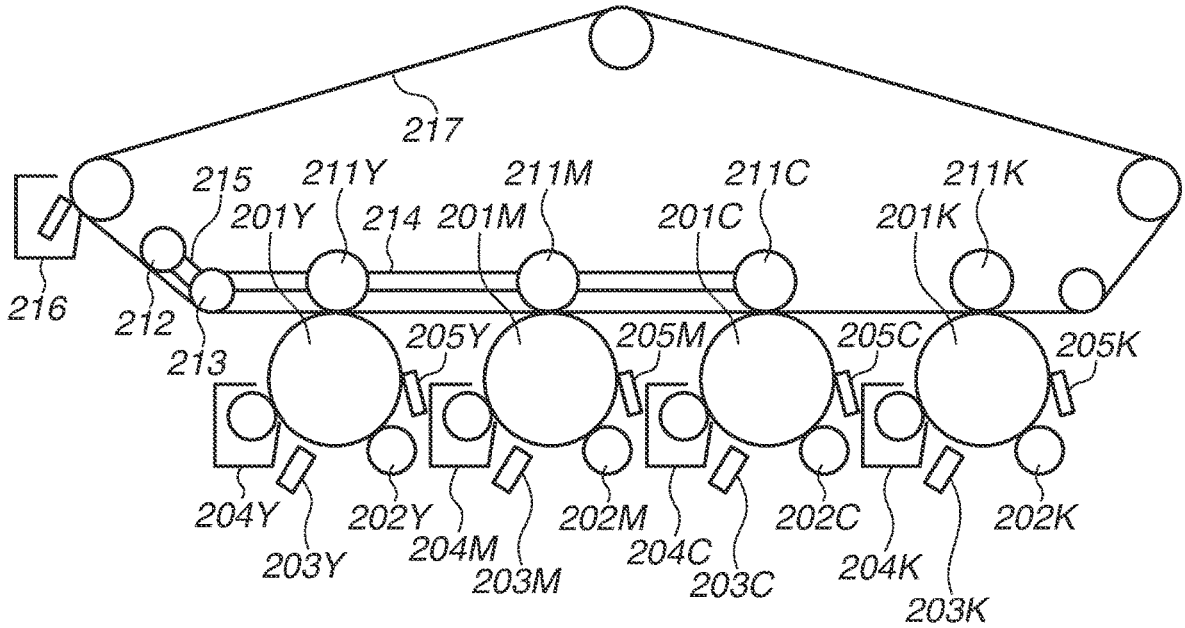

FIG. 2B illustrates the position of the transfer belt 217 in the full color mode. In the full color mode, when the positioning members 214 and 215 are moved to contact positions, the primary transfer rollers 211Y, 211M, and 211C are moved downward. As a result, the transfer belt 217 comes into contact with the photosensitive drums 201Y, 201M, and 201C. A time period necessary for transition from the separation state to the contact state is called a contact time period Ts. As an example, the contact time period Ts is 900 milliseconds.

<Control Unit>

Figure 3:
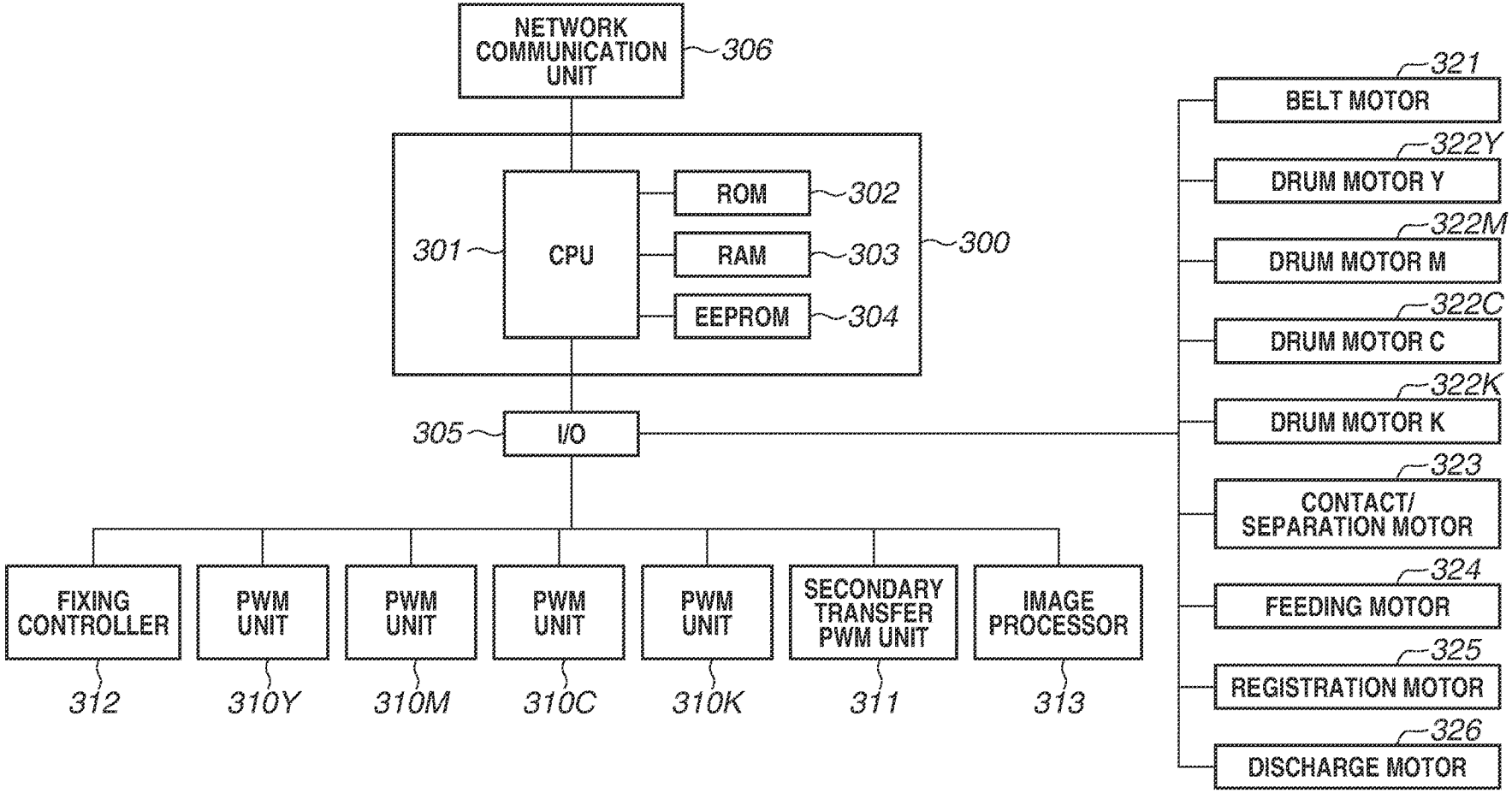
FIG. 3 is a block diagram illustrating a control unit.

FIG. 3 is a diagram illustrating a control unit 300 of the image forming apparatus 100. The control unit 300 includes a central processing unit (CPU) 301, a read only memory (ROM) 302, and a random access memory (RAM) 303. The CPU 301 controls the image forming units and the like based on control programs stored in the ROM 302. The RAM 303 is a memory storing a flag, variables, and the like. A network communication unit 306 is a communication circuit communicating with a host computer.

Upon receiving a print instruction (job) via the network communication unit 306, the CPU 301 starts a print operation. The CPU 301 controls various kinds of load relating to image formation via an input/output (I/O) unit 305. The CPU 301 drives a feeding motor 324 to rotate the pickup roller 102. In addition, the CPU 301 drives a registration motor 325 to rotate the registration roller 105. Furthermore, the CPU 301 drives a discharge motor 326 to rotate the discharge roller 108 and a fixing roller inside the fixer 140.

The CPU 301 drives a drum motor 322 through the I/O unit 305 to rotate the photosensitive drum 201, the charging roller 202, and the developer 204 that use the drum motor 322 as a driving source. The CPU 301 drives a belt motor 321 via the I/O unit 305 to rotate the primary transfer roller 211 and the tension rollers 212 and 213 that use the belt motor 321 as a driving source. Further, the transfer belt 217 is rotated along with rotation of the rollers.

The CPU 301 drives a contact/separation motor 323 via the I/O unit 305 to move the positioning members 214 and 215 that use the contact/separation motor 323 as a driving source, to the contact positions and the separation positions. The contact/separation motor 323 can perform forward rotation and reverse rotation, and movement is switched between movement to the contact positions and movement to the separation positions based on a rotation direction.

The CPU 301 instructs a pulse-width modulation (PWM) unit 310 via the I/O unit 305. The PWM unit 310 controls voltages applied to the charging roller 202, the developer 204, and the primary transfer roller 211, and a laser beam amount of the laser unit 203 via PWM control. Further, the CPU 301 controls a voltage (secondary transfer bias) applied to the secondary transfer roller 120 via the secondary transfer PWM unit 311. A fixing controller 312 controls a heater temperature of the fixer 140. The CPU 301 can issue an instruction to an image processor 313 via the I/O unit 305. The instruction includes a mode designation instruction and an image output instruction. The mode designation instruction is an instruction to designate the monochrome mode or the full color mode. In a case where the monochrome mode is designated, the image processor 313 outputs an image signal to the laser unit 203K. In a case where the full color mode is designated, the image processor 313 outputs the image signal to the laser units 203Y to 203K.

<Basic Operation>

Basic operations of each of the image forming units include a contact/separation operation, a rotation operation, image formation preparation, image formation, and secondary transfer. The contact/separation operation includes a contact operation in which the photosensitive drum 201 and the transfer belt 217 are in contact with each other, and separation operation in which the photosensitive drum 201 and the transfer belt 217 are separated from each other. The contact operation is typically performed in switching the mode from the monochrome mode to the full color mode. The separation operation is typically performed in switching the mode from the full color mode to the monochrome mode. Although the photosensitive drums 201Y, 201M, and 201C are rotated in the full color mode, the monochrome image can be formed. The rotation operation indicates that the drum motor 322 and the belt motor 321 are driven so that the photosensitive drum 201 and the transfer belt 217 are rotated at respective predetermined constant speeds. The image formation preparation indicates processing to put the image forming unit into a state where the image forming unit can form a toner image, and includes, for example, start of output of the charging bias and the developing bias. The image formation indicates an operation from start of laser beam emission until the primary transfer. The secondary transfer indicates transfer of the toner image from the transfer belt 217 onto a sheet.

Upon receiving a job, the CPU 301 rotates the pickup roller 102 to feed a sheet inside the cassette 101. On the other hand, the CPU 301 starts the image formation preparation and the image formation such that the toner images arrive at the secondary transfer portion by the time when the sheet arrives at the secondary transfer portion.

<Contact/Separation Operation>

Prior to the image formation preparation, the CPU 301 performs the contact operation or the separation operation of the transfer belt 217. In a case where an image (target image) to be formed in the print job is a color image, the CPU 301 moves the positioning members 214 and 215 to the contact positions.

<Rotation Operation>

The CPU 301 starts rotation of the photosensitive drums 201Y to 201K and the transfer belt 217. A rotation time period To from a time when rotation is started to a time when the photosensitive drum 201 and the transfer belt 217 are rotated at the respective predetermined constant speeds is, for example, 200 milliseconds. Thereafter, the image formation preparation is started in order from the yellow photosensitive drum 201Y that is located on a most upstream side in the conveyance direction of the toner images. In each of the photosensitive drums 201M to 205K that are located on a downstream side of the photosensitive drum 201Y, the image formation preparation is started at timing shifted by their respective predetermined times. For example, the start timing of the photosensitive drum 201M is delayed by the predetermined time from the start timing of the photosensitive drum 201Y. The predetermined time is a time obtained by dividing a conveyance distance from the primary transfer position of the photosensitive drum 201Y to the primary transfer position of the photosensitive drum 201M by a conveyance speed (moving speed of the transfer belt 217). For example, the predetermined time is 300 milliseconds. In the color mode, image formation becomes performable in all of the four colors after 900 milliseconds from completion of the yellow image formation preparation.

In contrast, in a case where the image to be formed in the print job is a monochrome image, the CPU 301 moves the positioning members 214 and 215 to the separation positions. As a result, the photosensitive drums 201Y to 201C and the transfer belt 217 are separated from each other. A time period necessary for the positioning members 214 and 215 to be moved from the contact positions to the separation positions is, for example, 900 milliseconds. Thereafter, the CPU 301 rotates the photosensitive drum 201K and the transfer belt 217, and starts image formation preparation of only black out of yellow, magenta, cyan, and black.

<Image Formation Preparation>

The image formation preparation for yellow is to be described as a representative example. The image formation preparation for the toner colors other than yellow is similarly performed. The CPU 301 instructs the PWM unit 301Y to apply the charging bias to the charging roller 202Y. When the photosensitive drum 201Y is rotated, a sufficiently-charged area on the surface of the photosensitive drum 201Y arrives at the developer 204Y. When the charged area arrives at the developer 204Y, the CPU 301 instructs the PWM unit 310Y to apply the developing bias to the developer 204Y. At this time, a time period from a time when the charging bias is applied to the charging roller 202Y to a time when the photosensitive drum 201Y is sufficiently charged is, for example, 100 milliseconds. A time period necessary for the charged area to be moved from the charging roller 202Y to the developer 204Y is, for example, 100 milliseconds. In other words, the image formation preparation takes 200 milliseconds in total. The time period necessary for the image formation preparation may be referred to as a preparation time period Tp.

<Image Formation>

The image formation for yellow is to be described as a representative example. The image formation for the other toner colors is similarly performed. After the image formation preparation is completed, the CPU 301 outputs an image output instruction to the image processor 313. When the image processor 313 starts to output an image signal to the laser unit 203Y, the laser unit 203Y starts to emit the laser beam. As a result, a latent image is formed on the photosensitive drum 201Y. When the photosensitive drum 201Y is rotated, the latent image arrives at a position facing the developer 204Y, and the latent image is developed with yellow toner. As a result, the toner image is formed. Thereafter, the toner image on the photosensitive drum 201Y is conveyed to the primary transfer roller 211Y. The CPU 301 applies the primary transfer bias to the primary transfer roller 211Y, thereby transferring the toner image to the transfer belt 217.

<Secondary Transfer>

The toner image transferred to the transfer belt 217 is conveyed to the secondary transfer portion by rotation of the transfer belt 217. A conveyance time period Tt corresponding to a distance of a conveyance section from the primary transfer position of the photosensitive drum 201K to the secondary transfer position of the secondary transfer roller 120 is, for example, 300 milliseconds. The CPU 301 applies the secondary transfer bias to the secondary transfer roller 120, thereby transferring the toner image to the sheet.

In a case where images are formed on a plurality of sheets in the print job, a distance from a preceding image to a succeeding image on the transfer belt 217 is maintained at a constant distance (distance between sheets). A time period Ti corresponding to the distance between sheets is a kind of waiting time, and is, for example, 100 milliseconds. The reason why such a waiting time is necessary is because a predetermined processing time is necessary for the image processor 313 to prepare a next image after the image processor 313 outputs one image.

<Mode Switching>

In a job to print a plurality of pages, a monochrome image and a color image may be mixed. In this case, it is necessary to switch the mode from the monochrome mode to the full color mode. As an example, a job in which monochrome images of two pages are formed, and then color images of two pages are formed is adopted.

<Mode Switching Operation>

In a case where the job has job contents to print a plurality of pages and the monochrome image and the color image are mixed, a mode switching operation is performed during the job.

Figure 4A:
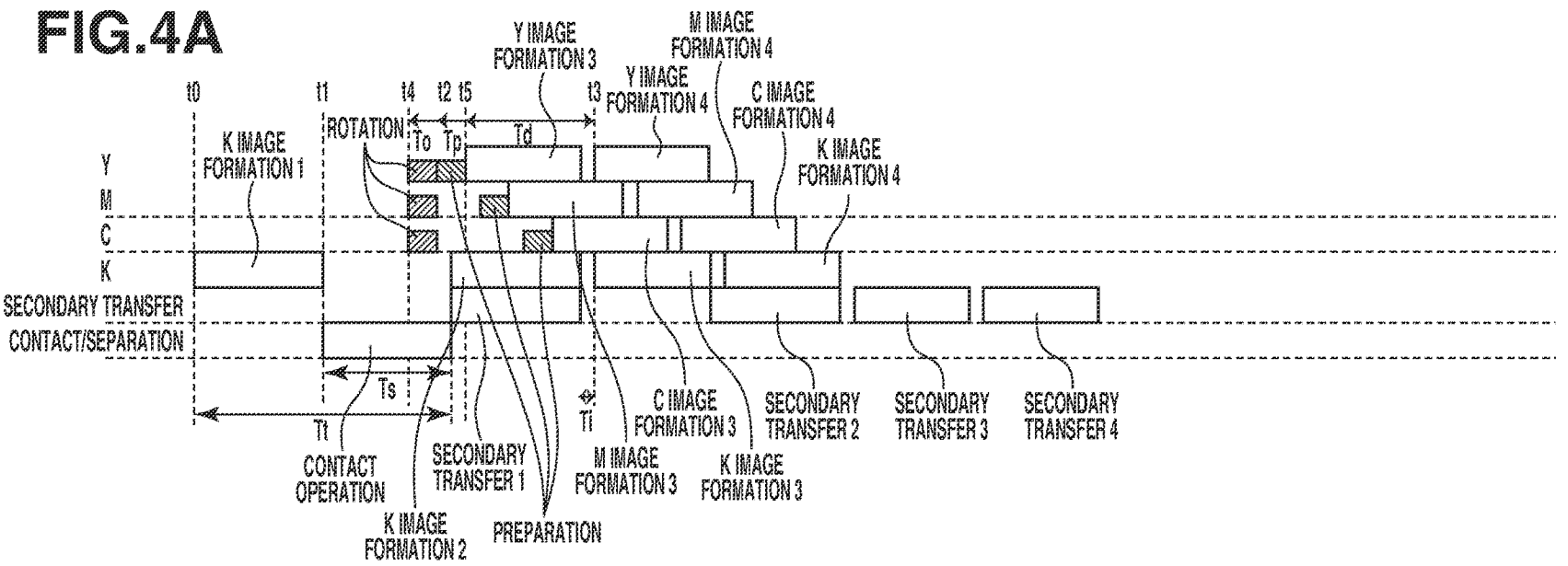
FIGS. 4A, 4B, and 4C are diagrams illustrating timing of switching a mode from a monochrome mode to a color mode.
Figure 4B:
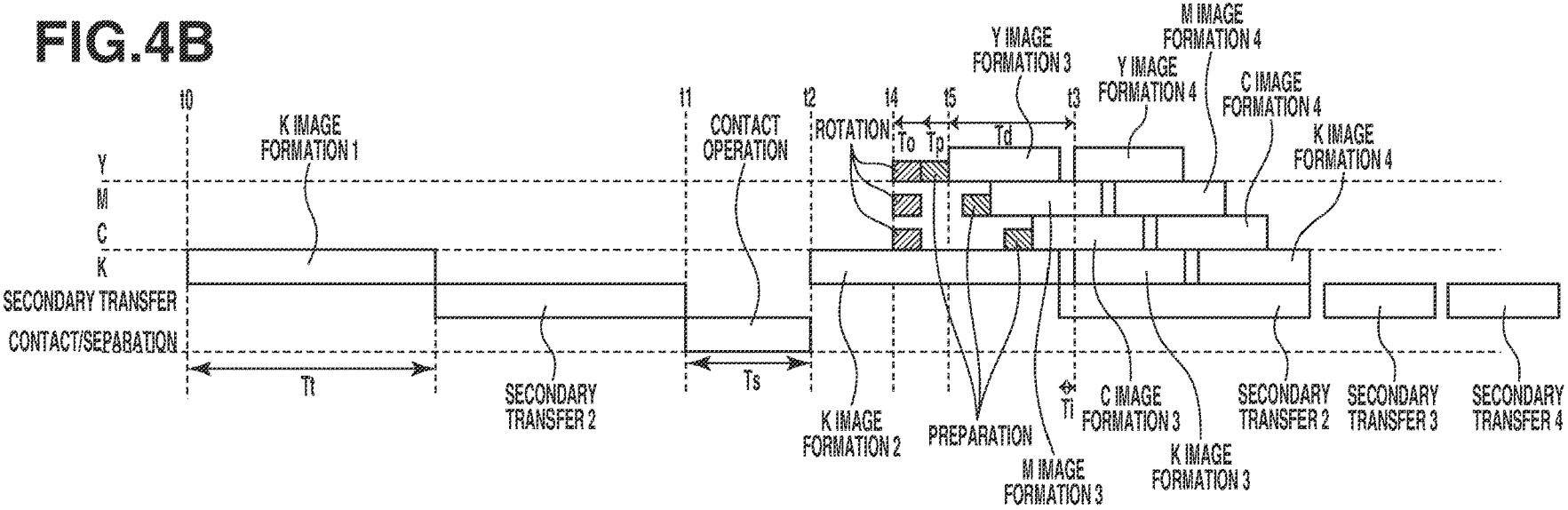
Figure 4C:
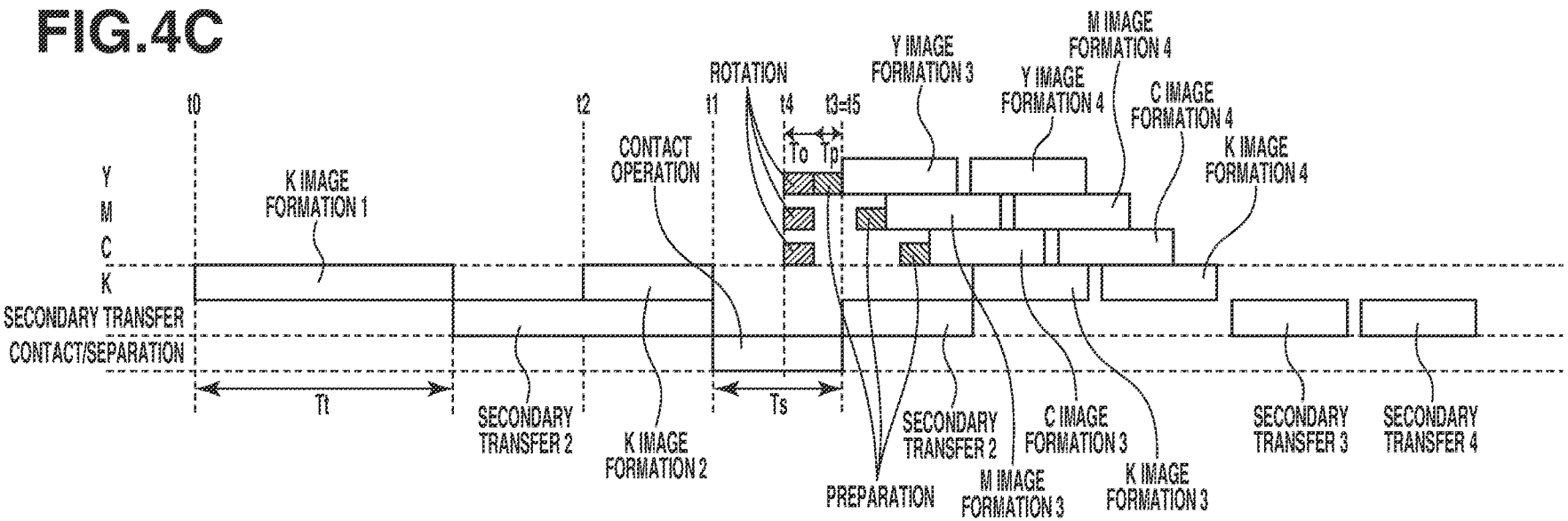

FIGS. 4A to 4C are timing charts schematically illustrating the mode switching operation to switch the mode from the monochrome mode to the full color mode according to the present exemplary embodiment. In the print job described in the present exemplary embodiment, the mode is not switched from the full color mode to the monochrome mode.

In FIGS. 4A to 4C, a period labeled "rotation" indicates a period from a time when rotation of the photosensitive drum of the corresponding color is started to a time when the rotation is stabilized. A period labeled "preparation" indicates a period in which the image formation preparation of the corresponding color is being performed. A period labeled "K image formation 1" or the like indicates a period in which the image formation of the corresponding color is being performed, and a number at the end represents a page number of the image. In other words, the period labeled "K image formation 1" indicates a period when a K image on a first page is being formed. A period labeled "secondary transfer 1" or the like indicates a period when an image is being transferred to a sheet, and a number at the end represents a page number of the image. In other words, the period labeled "secondary transfer 1" indicates a period when the image on the first page transferred on the intermediate transfer belt 217 is being transferred to a sheet. Further, a period labeled "contact operation" indicates a period when the contact operation of the transfer belt 217 is being performed.

In the present exemplary embodiment, a time period corresponding to a distance between the photosensitive drum 201Y and the photosensitive drum 201K is Td, a time period corresponding to a distance from the photosensitive drum 201K to the secondary transfer roller 120 is Tt, a time period until rotation is stabilized is To, and a time period necessary for the image formation preparation is Tp. Further, a waiting time period (image interval) between images in successive formation of images on a plurality of pages is Ti, and a time period necessary for the contact operation is Ts. As described above in the section of the basic operation, the time period Td is 900 milliseconds, the time period Tt is 1800 milliseconds, the time period To is 200 milliseconds, the time period Tp is 200 milliseconds, the time period Ti is 100 milliseconds, and the time period Ts is 900 milliseconds. The time periods in the exemplary embodiment of the present disclosure are not limited to these numerical values.

FIGS. 4A to 4C each illustrate a case where two pages of monochrome images are followed by two pages of color images. In other words, image formation is performed in order of a monochrome image on a first page (1), a monochrome image on a second page (2), a color image on a first page (3), and a color image on a second page (4). In FIGS. 4A to 4C, an image length of the monochrome image on the first page and an image length of the monochrome image on the second page are different. FIG. 4A illustrates a case where the image lengths of both of the monochrome image on the first page and the monochrome image on the second page are relatively short. FIG. 4B illustrates a case where the image lengths of both of the monochrome image on the first page and the monochrome image on the second page are relatively long. FIG. 4C illustrates a case where the image length of the monochrome image on the first page is relatively long whereas the image length of the monochrome image on the second page is relatively short. Note that whether the described monochrome image on the first page is located at a head or in middle of the job does not matter. For this reason, the rotation of the photosensitive drum and the image formation preparation of black may be performed at any timing before time t0 at which the K image formation 1 is started.

First, at time t0, the image formation of the monochrome image on the first page is started. In the present exemplary embodiment, start timing of image formation of a next page is determined at the same time as the image formation of the monochrome image on the first page. Further, whether to switch the mode from the monochrome mode to the full color mode is determined based on information on a succeeding page. In this example, the second page of the monochrome image is followed by a page of a color image, and the mode needs to be switched to the full color mode. If the image formation of the monochrome image on the second page is started according to the order of the pages while the mode is the monochrome mode, a period when the monochrome image is not formed is generated in addition to the period of the contact operation as with the existing technology. Accordingly, it is necessary to appropriately determine a time t1 at which the contact operation is started, a time t2 at which the image formation of the monochrome image on the second page is started, and a time t4 at which rotation of the photosensitive drums and the image formation preparation of yellow and other colors are started. A method of determining each of the times is to be described in detail below with reference to FIG. 5.

Likewise, at the time t2, a time t5 at which the image formation of the color image on the first page is started is determined. Each operation is performed based on the corresponding time determined in the above-described manner. The meanings of the times are the same in FIGS. 4A to 4C. However, the order of these times are different because an appropriate operation order is changed depending on the image lengths of the monochrome image on the first page and the monochrome image on the second page.

Figure 5:
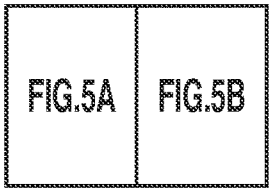
FIG. 5 (divided into FIG. 5A and FIG. 5B) is a flowchart illustrating a control operation.
Figure 5A:
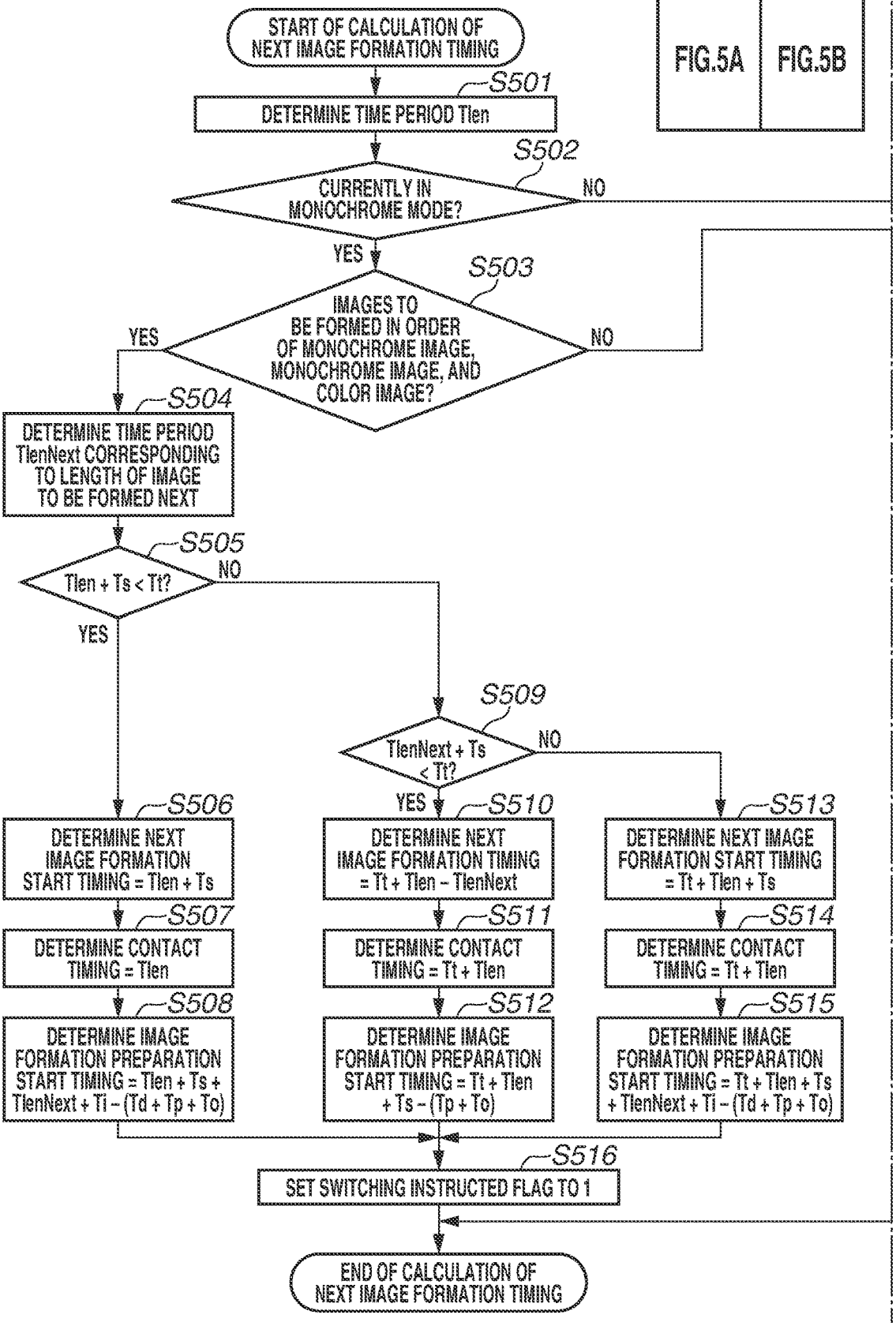
Figure 5B:
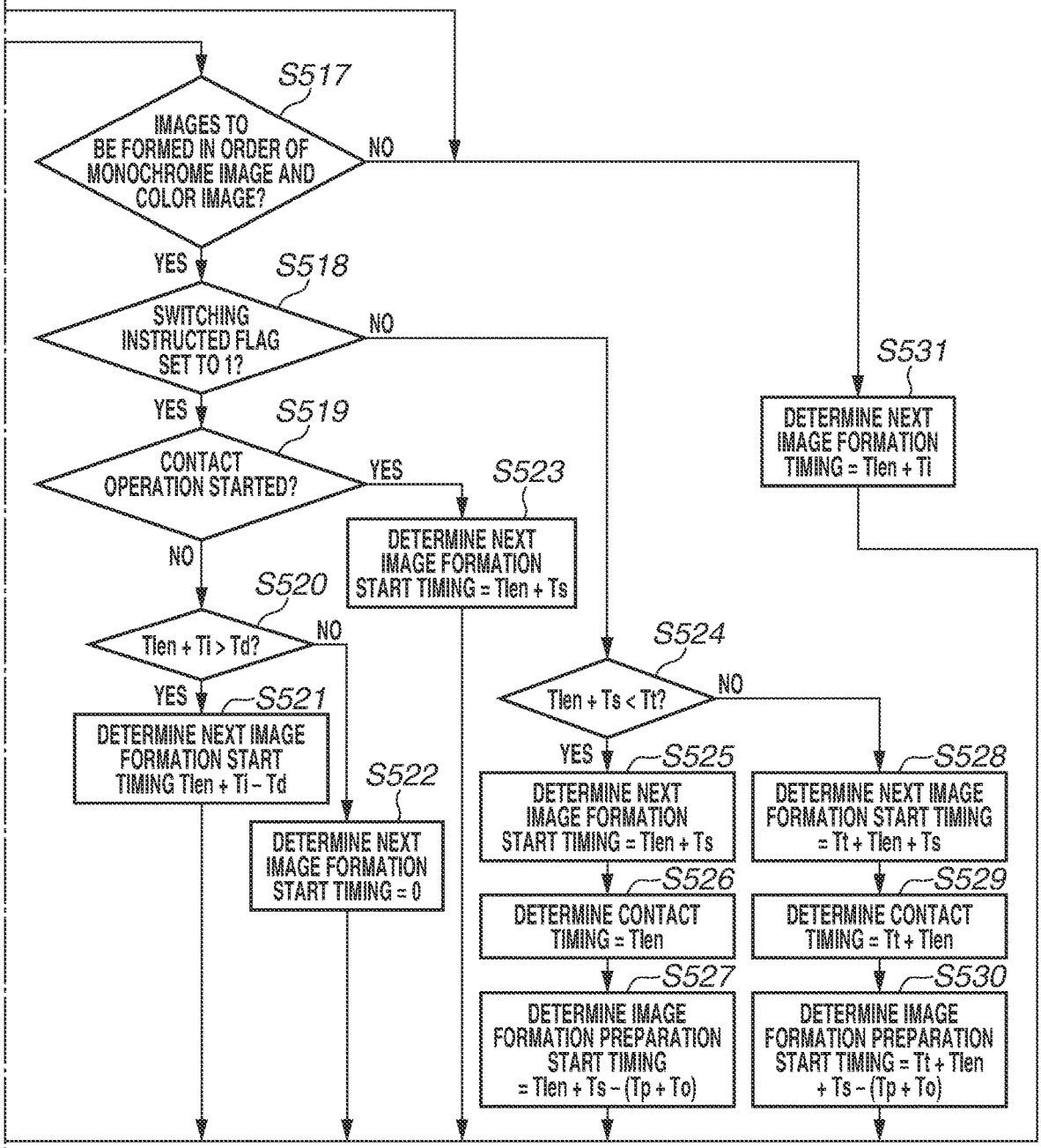
Figure 6A:
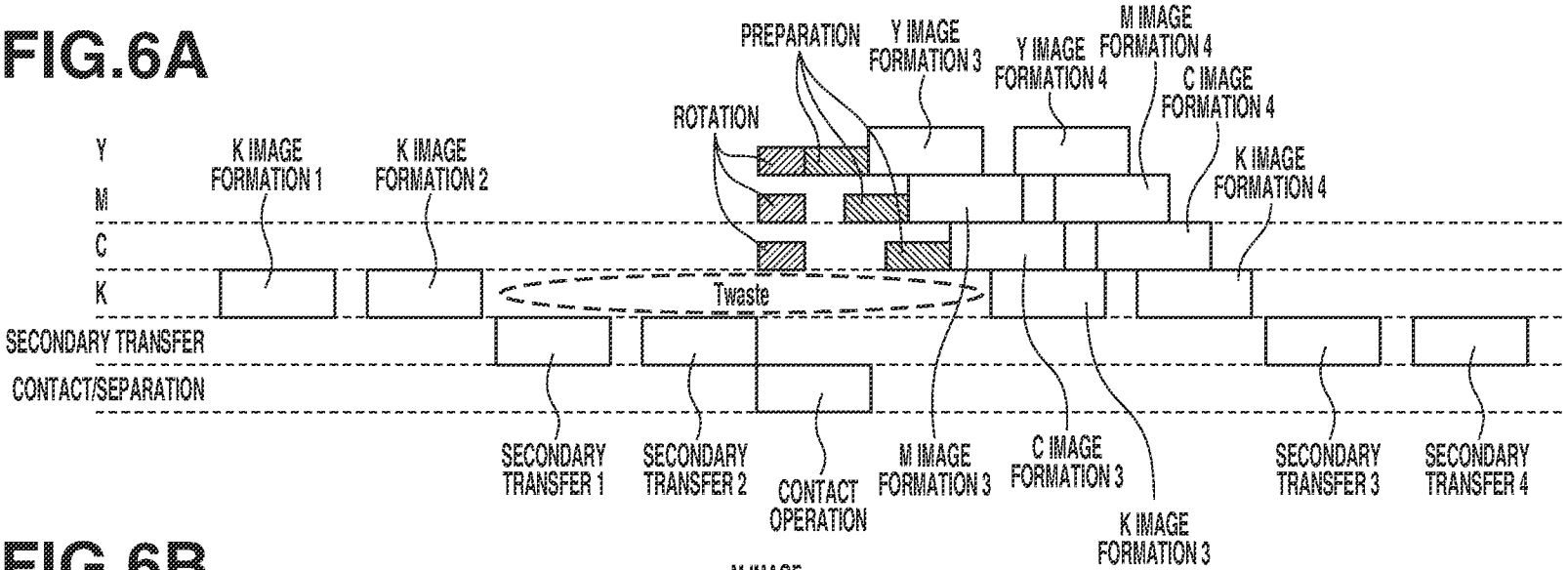
FIGS. 6A, 6B, and 6C are diagrams illustrating conventional timing of switching a mode from the monochrome mode to the color mode.
Figure 6B:
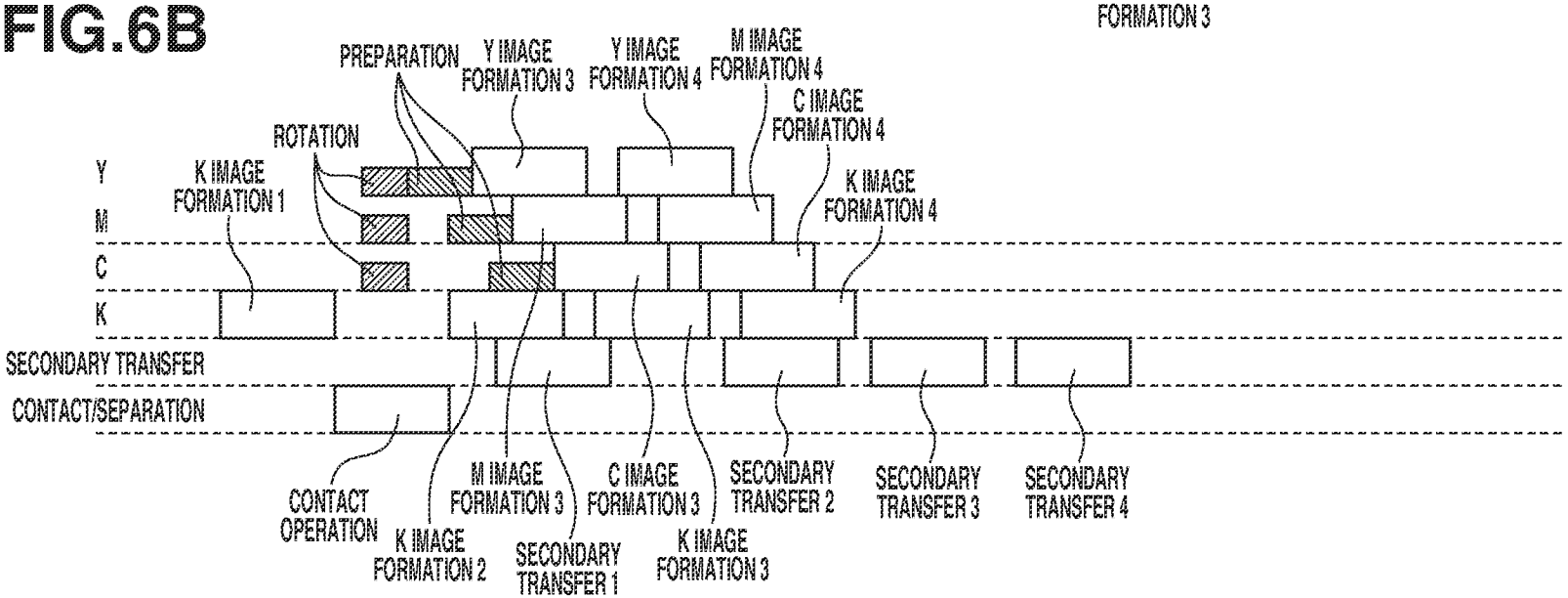
Figure 6C:
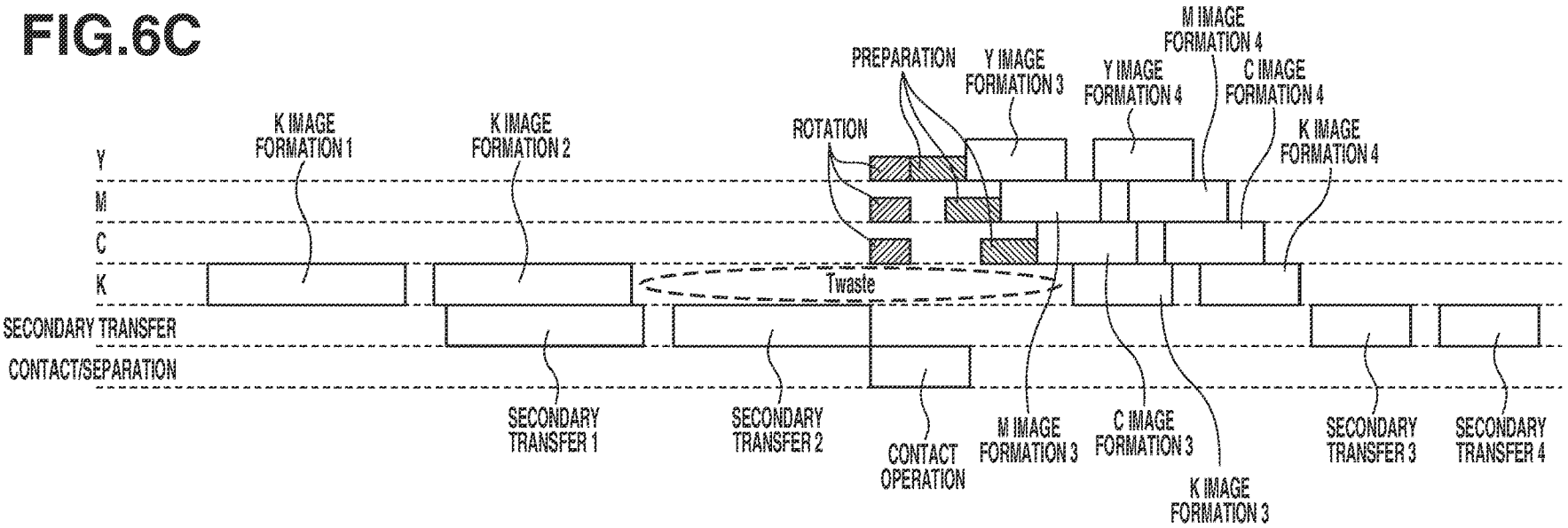

FIG. 5 (divided into FIGS. 5A and 5B) is a flowchart of processing to determine start timing of next image formation to be performed by the CPU 301. In the flowchart of FIG. 5, the processing is started at image formation start timing of a head color on each page. In other words, in the case of the monochrome image, the processing is started at timing on a left end of the period "K image formation" in FIGS. 4A to 4C. In the case of the color image, the processing is started at timing on a left end of the period "Y image formation". The image formation on a head page in the job is started at timing at which the image formation preparation of the color on the head page is completed, without qualification. The processing in the flowchart is performed only once on each page at timing at which the image formation on each page is started. Therefore, the processes for a plurality of pages are not performed in parallel.

First, in step S501, the CPU 301 acquires a length of an image to be formed, and determines a time period Tlen corresponding to the length. Next, in step S502, the CPU 301 checks whether the current mode is the monochrome mode. In a case where the current mode is the monochrome mode (YES in step S502), it is necessary to switch the mode to the color mode depending on next and succeeding pages. For this reason, the CPU 301 checks the next and succeeding pages. More specifically, in step S503, the CPU 301 determines whether images to be formed are to be processed in order of a monochrome image, a monochrome image, and a color image. FIGS. 4A to 4C are time charts in the case where the images are formed in order of a monochrome image, a monochrome image, and a color image. In a case where a determination result in step S503 is YES (YES in step S503), the CPU 301 calculates an appropriate start time of each operation for switching the mode to the color mode.

First, in step S504, the CPU 301 determines a time period TlenNext corresponding to a length of an image to be formed next. In step S505, the CPU 301 determines whether a value obtained by adding the time period Ts to the time period Tlen is less than the time period Tt. In this determination, the following two conditions are to be determined. A first condition is that the monochrome image on the first page transferred to the intermediate transfer belt 217 has a length falling within a section from the position of the photosensitive drum 201K (primary transfer position) to the secondary transfer roller 120. A second condition is that the contact operation is completed before a leading end of the monochrome image on the first page arrives at the secondary transfer roller 120. In a case where Tlen+Ts<Tt is satisfied in step S505 (YES in step S505), the operation illustrated in FIG. 4A is performed. In this case, next image formation of the monochrome image on the second page can be started when the contact operation is finished. Therefore, in step S506, the CPU 301 sets the start timing t2 of the image formation of the monochrome image on the second page to a time point at which a time period (Tlen+Ts) has elapsed since the time t0. Further, the contact operation can be started at the time point after transfer of the monochrome image on the first page to the intermediate transfer belt 217 is completed. Therefore, in step S507, the CPU 301 sets the time t1 at which the contact operation is performed to a time point at which the time period Tlen has elapsed since the time t0. The time t4 at which the preparation operation for the colors other than black is started for image formation of a color image next to the monochrome image on the second page, is set so as to be in time for start of the image formation of the color image on the first page while a period "K image formation 2" of the monochrome image on the second page is not overlapped with a period "K image formation 3" of the color image on the first page. In other words, in step S508, the CPU 301 sets the time t4 to a time point at which a time period {Tlen+Ts+TlenNext+Ti−(Td+Tp+To)} has elapsed since the time t0. As a result, preparation can be performed without waste.

In a case where Tlen+Ts<Tt is not satisfied in step S505 (NO in step S505), the CPU 301 determines in step S509 whether the time period TlenNext+Ts is less than the time period Tt. In this determination, the following two conditions are to be determined. A first condition is that the monochrome image on the second page transferred on the intermediate transfer belt 217 has a length falling within a section from the position of the photosensitive drum 201K (primary transfer position) to the secondary transfer roller 120. A second condition is that the contact operation can be completed before a leading end of the monochrome image on the second page arrives at the secondary transfer roller 120.

In a case where TlenNext+Ts<Tt is satisfied in the determination in step S509 (YES in step S509), the operation illustrated in FIG. 4C is performed. In this case, it is necessary to complete the image formation of the monochrome image on the second page before the contact operation is started. Therefore, in step S510, the CPU 301 sets the time t2 to a time point at which a time period (Tt+Tlen−TlenNext) has elapsed since the time t0. Further, it is necessary to start the contact operation after the monochrome image on the first page is transferred to a sheet. Therefore, in step S511, the CPU 301 sets the time t1 to a time point at which a time period (Tt+Tlen) has elapsed since the time t0. To start the image formation of the color image on the first page next to the monochrome image on the second page after the contact operation is completed, the CPU 301 sets, in step S512, the time t4 to a time point at which a time period {Tt+Tlen+Ts−(Tp+To)} has elapsed since the time t0.

In a case where TlenNext+Ts<Tt is not satisfied in step S509 (NO in step S509), the operation illustrated in FIG. 4B is performed. In this case, the image formation of the monochrome image on the second page is started immediately after the contact operation is completed. Therefore, in step S513, the CPU 301 sets the time t2 to a time point at which a time period (Tt+Tlen+Ts) has elapsed since the time t0. Further, it is necessary to start the contact operation after the monochrome image on the first page is transferred to a sheet. Therefore, in step S514, the CPU 301 sets the time t1 to a time point at which the time period (Tt+Tlen) has elapsed since the time t0. Further, to start the image formation of the color image on the first page after the contact operation is completed, the CPU 301 sets, in step S515, the time t4 to a time point at which a time period (Tt+Tlen+Ts+TlenNext+Ti−(Td+Tp+To)) has elapsed since the time t0.

In the case where the determination result in step S503 is YES, in any of the cases in FIGS. 4A to 4C, the CPU 301 sets, in step S516, a switching instructed flag representing that execution of switching is fixed to 1 after determination of each operation time. Note that the switching instructed flag is initialized to 0 when the print job is started. Thereafter, each operation is started at the determined time. In the present exemplary embodiment, transition to the full color mode is completed at the time point at which the contact operation is completed and the image formation preparation of yellow color that is a first color in the color image formation is completed.

The determination result in step S503 is NO in a case where monochrome images are consecutive over a plurality of pages or in a case where a monochrome image is to be formed immediately before the mode is switched to the full color mode. In a case where the determination result in step S503 is NO (NO in step S503), the CPU 301 determines in step S517 whether next images are to be formed in order of a monochrome image and a color image. In FIGS. 4A to 4C, the time period Tlen is a value corresponding to the monochrome image on the second page.

In a case where a determination result in step S517 is YES (YES in step S517), the CPU 301 determines in step S518 whether the switching instructed flag has been set to 1. In a case where the switching instructed flag has been set to 1 (YES in step S518), the start time of the contact operation of the intermediate transfer belt 217 and the start time of the image formation preparation for colors other than black in the color image formation have been already determined in any of the cases in FIGS. 4A to 4C. Therefore, only processing to determine the start time t5 of the image formation of a next image, namely, the color image on the first page is to be performed. First, in step S519, the CPU 301 determines whether the contact operation has been started before the image formation of the monochrome image on the second page is started. In the case of FIG. 4A or 4B, a determination result in step S519 is NO (NO in step S519). In this case, in step S520, the CPU 301 further determines whether a time period Tlen+Ti is greater than the time period Td. In a case where a determination result in step S520 is YES (YES in step S520), it is necessary to prevent the period of the image formation of the color image on the first page from overlapping the period of the secondary transfer of the monochrome image on the second page. Accordingly, in step S521, the CPU 301 sets the start time t5 of the image formation of a first color of the color image on the first page to a time point at which a time period Tlen+Ti−Td has elapsed since the time t2. In other words, the time t5 is a time at which a value obtained by subtracting a length of the color image on the first page from a distance corresponding to a time obtained by adding the image interval Ti to the length Tlen of the monochrome image on the second page has elapsed since the time t2. In a case where the determination result in step S520 is NO (NO in step S520), the period of the secondary transfer of the monochrome image on the second page and the period of the image formation of the color image on the first page are not overlapped with each other. For this reason, the image formation of the first color of the color image on the first page may be immediately started. Accordingly, in step S522, the CPU 301 sets the start time t5 of the image formation of the color image on the first page to the time t2. In this case, the image formation (Y image formation 3) of the color image on the first page is to be performed in parallel with the image formation (K image formation 2) of the monochrome image on the second page.

In the case of FIG. 4C, the determination result in step S519 is YES (YES in step S519). In this case, the contact operation of the intermediate transfer belt 217 is not started yet. For this reason, it is necessary to start image formation of the color image on the first page after the contact operation is completed. Accordingly, in step S523, the CPU 301 sets the time t5 to a time point at which the time period Tlen+Ts has elapsed since the time t2.

In a case where an image on the first page of the job is a monochrome image and an image on the second page is a color image (not illustrated), the determination result in step S517 is YES, and the switching instructed flag is not 1. In this case, it is also necessary to switch the mode to the color mode. For this reason, it is necessary to determine the time of each operation. First, in step S524, the CPU 301 determines whether the time period Tlen+Ts is less than the time period Tt. In a case where a determination result in step S524 is YES (YES in step S524), the contact operation can be completed while the monochrome image is moved on the intermediate transfer belt 217. Accordingly, in step S525, the CPU 30 sets the formation start time of next color image to a time point at which the time period Tlen+Ts has elapsed since the monochrome image formation is started. Further, in step S526, the CPU 301 sets the start time of the contact operation to a time point at which the time period Tlen has elapsed since the monochrome image formation is started. In step S527, the CPU 301 sets the start time of the image formation preparation of colors other than black to a time point at which a time period Tlen+Ts−(Tp+To) has elapsed since the monochrome image formation is started.

In contrast, in a case where the determination result in step S524 is No (NO in step S524), the operation is inevitably performed in order of the pages. Accordingly, in step S528, the CPU 301 sets the start time of the image formation of the next color image to a time point at which the time period Tt+Tlen+Ts has elapsed since the monochrome image formation is started. In addition, in step S529, the CPU 301 sets the start time of the contact operation to a time point at which the time period Tt+Tlen has elapsed since the monochrome image formation is started. In step S530, the CPU 301 sets the start time of the image formation preparation for colors other than black, to a time point at which the time period Tt+Tlen+Ts−(Tp+To) has elapsed since the monochrome image formation is started.

In a case where a color image is formed in a state where the print color mode of the image formation is set to the full color mode, the mode is never switched to the full color. Accordingly, in a case where a determination result in step S502 is NO (NO in step S502), the CPU 301 sets, in step S531, the formation start time of next image to a time point at which a time period Tlen+Ti has elapsed since the monochrome image formation is started, based on the basic operation. Further, in a case where monochrome images are consecutive after monochrome images of two pages are formed during formation of the monochrome image in the monochrome mode, it is not necessary to switch the mode to the full color mode. In this case, the formation start time of next image is also set to a time point at which the time period Tlen+Ti has elapsed since the monochrome image formation is started.

As described above, according to the present exemplary embodiment, when the mode is switched from the monochrome mode to the full color mode, the start timing of each of the image formation of each page, the contact operation, and the image formation preparation is determined based on the length of the monochrome image in the moving direction of the intermediate transfer belt. As a result, formation of the monochrome image and formation of the next color image can be partially performed in parallel, which makes it possible to reduce the time necessary for the print job including the switching operation from the monochrome mode to the full color mode.

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may include one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read-only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2019-158964, filed Aug. 30, 2019, which is hereby incorporated by reference herein in its entirety.

What is claimed is:

1. An image forming apparatus, comprising:

a first image forming unit configured to form a first toner image;

a second image forming unit configured to form a second toner image of a color different from a color of the first toner image;

an intermediate transfer member to which the first toner image and the second toner image are transferred, and configured to convey the transferred first and second toner images to a sheet transfer position;

a contact/separation unit configured to switch a mode between a first mode in which the intermediate transfer member is in contact with the first image forming unit disposed on a downstream side of the second image forming unit in a conveyance direction of the first and second toner images by the intermediate transfer member and the intermediate transfer member is separated from the second image forming unit, and a second mode in which the intermediate transfer member is in contact with the first image forming unit and the second image forming unit; and a controller configured to control an operation of the image forming apparatus, wherein, in a case where a first image, that is a monochrome image formed using the first image forming unit without using the second image forming unit, a second image, that is the monochrome image, and a third image, that is a color image formed using the first image forming unit and the second image forming unit, are formed in order on sheets, the controller controls the contact/separation unit to switch the mode from the first mode to the second mode after transfer of the first image to the intermediate transfer member is completed and before formation of the second image by the first image forming unit is started if a first image length that is a length of the first image in the conveyance direction is smaller than a predetermined length, and wherein, after the first image is transferred to the sheet, the controller controls the contact/separation unit to switch the mode from the first mode to the second mode if the first image length in the conveyance direction is greater than the predetermined length.

2. The image forming apparatus according to claim 1, wherein, if the first image length in the conveyance direction is smaller than the predetermined length, the controller controls the second image forming unit to form the third image in parallel with formation of the second image by the first image forming unit.

3. The image forming apparatus according to claim 1, wherein the second image forming unit includes a plurality of image forming units configured to form toner images of different colors.

4. The image forming apparatus according to claim 1, wherein the predetermined length is determined based on a first distance from a position where the first toner image is transferred to the intermediate transfer member by the first image forming unit to a position where the first toner image is transferred to the sheet, and a second distance for which the intermediate transfer member is moved during a time period necessary for switching the mode from the first mode to the second mode by the contact/separation unit.

5. The image forming apparatus according to claim 4, wherein, in a case where the first image length in the conveyance direction is greater than the predetermined length and a distance obtained by adding the first distance to a second image length that is a length of the second image in the conveyance direction is smaller than the second distance, the controller controls the first image forming unit and the contact/separation unit to switch the mode from the first mode to the second mode after transfer of the first image to the sheet is completed and formation of the second image is completed, and wherein, in a case where the first image length in the conveyance direction is greater than the predetermined length and the distance obtained by adding the first distance to the second image length in the conveyance direction is greater than the second distance, the controller controls the first image forming unit and the contact/separation unit to start forming the second image after the mode is switched from the first mode to the second mode.

6. The image forming apparatus according to claim 5, wherein, in a case where the first image length in the conveyance direction is greater than the predetermined length and the distance obtained by adding the first distance to the second image length in the conveyance direction is greater than the second distance, the controller controls the first image forming unit to form the second image and the second image forming unit to form the third image in parallel with each other.

7. The image forming apparatus according to claim 4, wherein the predetermined length is a length obtained by subtracting the second distance from the first distance.

* * * * *